United States Patent [19]

Hamilton

[11] 4,292,856

[45] Oct. 6, 1981

[54] CONTROLLED FILM ADVANCE APPARATUS WITH DIFFERENTIAL SPEED

[76] Inventor: Joel A. Hamilton, 101 Hardenburgh, Demarest, N.J. 07627

[21] Appl. No.: 50,308

[22] Filed: Jun. 20, 1979

[51] Int. Cl.[3] ..... F16H 21/12; F16H 25/08

[52] U.S. Cl. ..... 74/63; 74/393

[58] Field of Search ..... 74/25, 42, 63, 65–69, 74/393, 394

[56] References Cited

U.S. PATENT DOCUMENTS

| | | | |
|---|---|---|---|
| 1,087,558 | 2/1914 | Sears | 74/393 |
| 3,076,351 | 2/1963 | Moss | 74/394 |
| 3,309,935 | 3/1967 | Jurny et al. | 74/393 |
| 3,548,669 | 12/1970 | Watkin | 74/394 |
| 3,605,506 | 9/1971 | Kuster | 74/63 |
| 3,763,717 | 10/1973 | Lenoir et al. | 74/394 |
| 4,048,782 | 9/1977 | Hamilton | 53/51 |

*Primary Examiner*—Lawrence J. Staab

*Attorney, Agent, or Firm*—Ralph R. Roberts

[57] ABSTRACT

A controlled film advance apparatus is disclosed in my U.S. Pat. No. 4,048,782 as issued on Sept. 20, 1977. It has been found that the apparatus and method of film advance as carried on the frame of the reference patent is advantageously returned at a speed which is greater than the forward speed. This film is intermittently moved and provides a longer period of repose as the films are formed, shaped or provided with similar operations. The improvement as shown in the drawings provides a means to adjust the speed of travel in and by the drive mechanism. Also shown is a speed reducer mechanism used in conjunction with the film advance apparatus.

10 Claims, 3 Drawing Figures

CONTROLLED FILM ADVANCE APPARATUS WITH DIFFERENTIAL SPEED

CROSS REFERENCE TO A RELATED PATENT

To the extent applicable, reference is made to the above identified U.S. Pat. No. 4,048,782 as issued on Sept. 20, 1977.

BACKGROUND OF THE INVENTION

1. Field of the Invention

With reference to the classification of art as established in and by the U.S. Patent Office, this application is believed to be in the same classification as my reference patent. Accordingly, this application is believed to be found in the general class entitled, "Package Making" (Class 53) and in the subclass entitled, "Registration Control" (subclass 51).

2. Description of the Prior Art

Bag making and package making is well known and is shown in my above-identified patent. The transport of rigid or semirigid film into a heated die or forms is well known. In the reference patent the films are advanced in a specified relationship to a filling cycle of the package. It has been found that the return cycle, in which the film is advanced as described in my patent, is preferably speeded up and the dwell time for package forming, filling and sealing is advantageously lengthened. The apparatus, to be hereinafter more fully described, provides a dissimilar time interval for the pitman arm motion in its movement of the film. The apparatus is not only adjustable as and with the distance moved but, in the embodiment shown and to be hereinafter more fully described, has a simple speed reduction also employed as a part of the drive apparatus.

SUMMARY OF THE INVENTION

This invention may be summarized, at least in part, with reference to its objects. It is an object of this invention to provide, and it does provide, a drive from a countershaft to a crankshaft. This crankshaft is slowed and speeded up by an input eccentric mounted on said crankshaft. This eccentric is moved by a speed reduced and driven crank arm carried on and by a sleeve rotatable on a support shaft which is preferably on a dead shaft which is non-rotating.

It is a further object of this invention to provide, and it does provide, a drive from a sleeve on a support shaft to a crankshaft which is slowed and speeded up by an input eccentric mounted on the crankshaft. The crankshaft is reduced in its rotational speed by speed reducing apparatus carried in and by a driven sheave rotatably carried on the support shaft. The driven sheave has a short shaft rotatably mounted in and carried by its web portion. This shaft has two timing belt pulleys carried thereon. One pulley is carried on each side of the web of the driven sheave. Each pulley is operatively connected to and drives like-length timing belts which drive timing belt pulleys carried on and are independently rotatable in sleeves carried on the support shaft which is non-moving. The reduced speed apparatus not only drives or moves a crank arm by which the eccentric is moved but as an output of the speed reducer apparatus also drives a V-belt and said crankshaft which moves the film members.

In brief, the apparatus, to be more fully described, includes an eccentric which as it is moved speeds up and slows down the crankshaft by which the film is advanced. In conjunction with and as a combination of the described and shown apparatus there is a simple speed reducing apparatus that slows down the motor output to a reasonable motion actuation. The motive force shown is an electric motor which carries and rotates a driver sheave mounted on the output shaft of the motor. This sheave carries and drives a V-belt which is also carried and drives a driven sheave. This sheave, as shown, is combined with a speed reducer apparatus to provide the desired rotational speed of the crankshaft.

The driven pulley is carried by and is freely rotatable on a fixed support shaft. The desired speed reduction is provided by a short shaft independently rotatable and carried in and by the web of this driven pulley. On this short shaft are mounted timing belt pulleys having a different number of teeth. A pair of like timing belts extend from the mounted pulleys on the short shaft to timing belt pulleys having a different number of teeth carried on sleeves rotatable on the support shaft. This support shaft carries a crank arm which is connected by a pitman arm to an eccentric on the crankshaft. The rotational speed of the crankshaft is slowed and speeded up by the movement of this eccentric which moves an arm associated with the speed reduction.

In addition to the above summary the following disclosure is detailed to insure adequacy in understanding of the invention. This disclosure, however, is not intended to cover each new inventive concept no matter how it may later be disguised by variations in form or additions of further improvements. For this reason there has been chosen a specific embodiment of a controlled film advance mechanism with a differential speed drive mechanism as adopted for use with packaging apparatus and showing a preferred means for reducing the output speed of a motor and feeding this output to the film advance apparatus. This specific embodiment has been chosen for the purpose of illustration and description as shown in the accompanying drawings wherein:

BRIEF DESCRIPTION OF THE DRAWINGS

In the following description and claims various details are identified by specific names for convenience. These names are intended to be generic in their application. Corresponding reference characters refer to like members throughout the three figures of the drawings.

The drawings accompanying, and forming part of, this specification disclose details of construction for the purpose of explanation but structural details may be modified without departure from the concept and principles of the invention and the invention may be incorporated in other structural forms than shown.

DESCRIPTION OF THE PREFERRED EMBODIMENT OF FIGS. 1 AND 2

Figure 1:
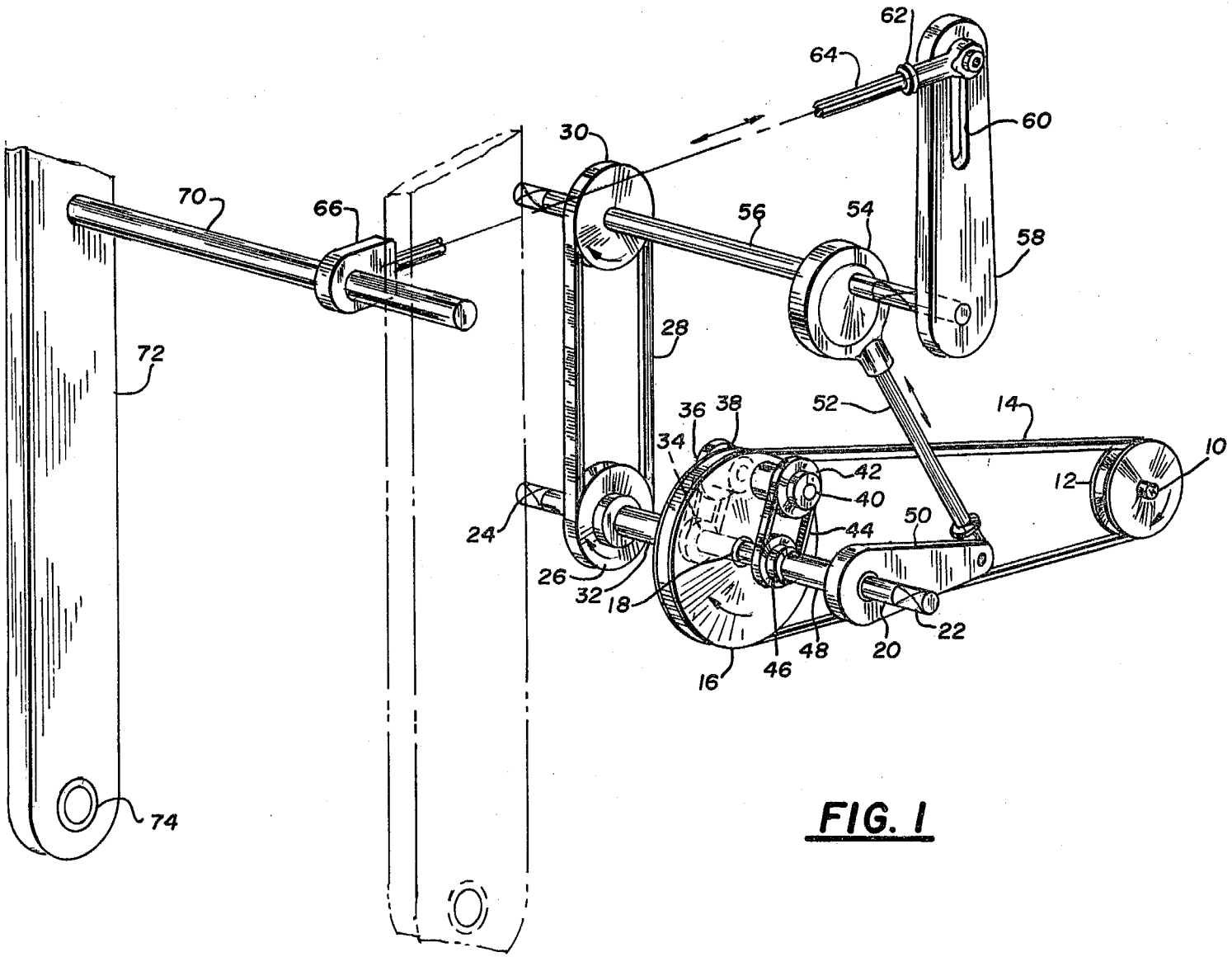
FIG. 1 represents an isometric view, partly diagrammatic, and showing means for adjusting the ratio or length limit of the pitman arm to the film advance.
Figure 2:
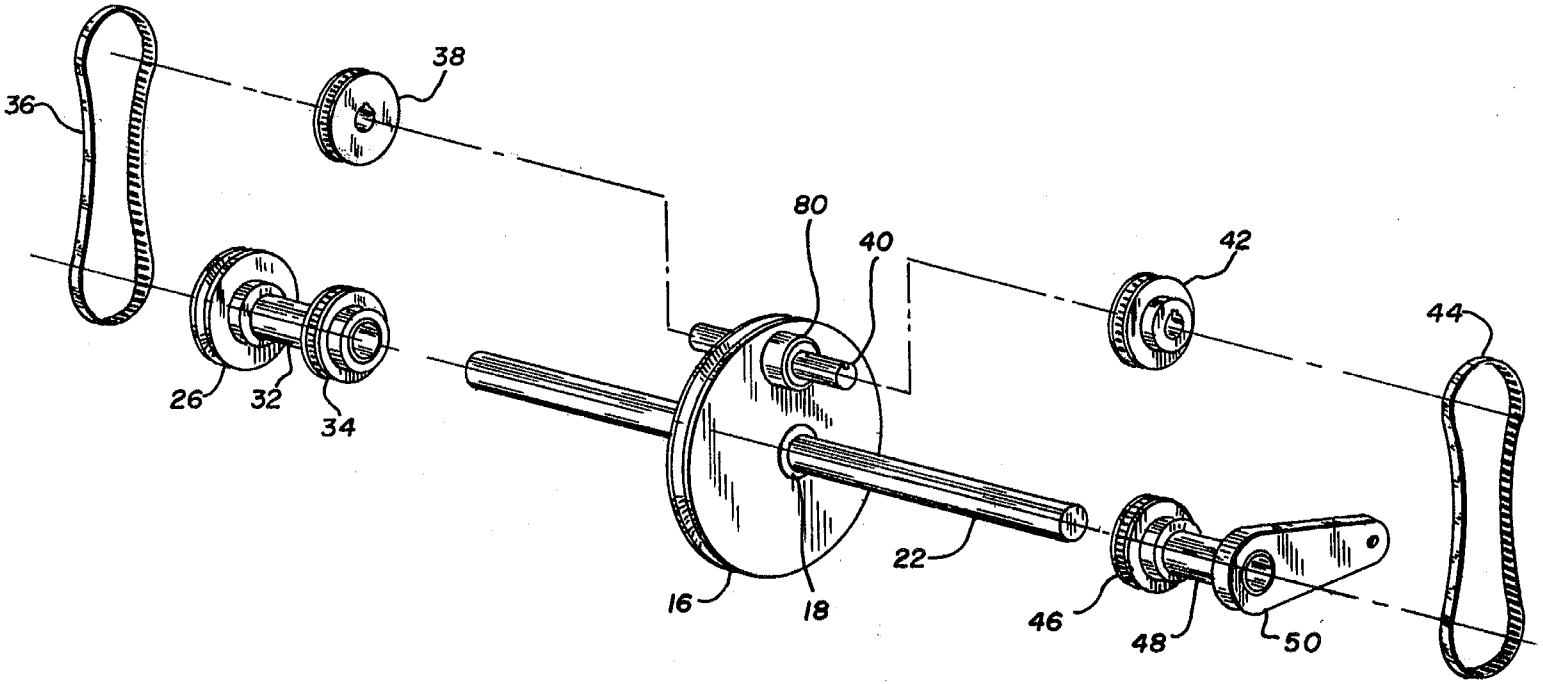
FIG. 2 represents an exploded isometric view showing the several components of the drive of FIG. 1 and providing a clarification of the operation of the drive apparatus.

Referring now to the drawings and in particular to the drive apparatus as shown in FIGS. 1 and 2 in which and whereby the depicted apparatus provides a differential movement of the film advance. The film advance apparatus having regular or equal movement of the film is shown in my U.S. Pat. No. 4,048,782. To the extent applicable, this application incorporates the embodiment shown and claimed in this above identified patent. In the drive, hereinafter more completely described, a motor shaft 10 is shown and carries on this shaft a driven pulley 12 which is secured to this shaft and rotates at and with the rotatable movement of the motor.

This shaft 12 moves a V-belt 14 which drives or rotates a pulley 16 which is mounted on a bearing 18. This bearing allows the pulley to be freely rotatable on a fixed shaft 20. Shaft 20 is carried by supports 22 and 24 although this shaft 20 is a fixed or dead shaft. A single support of course may be provided if desired. Freely rotatable on this shaft 20 is a sheave 26 which drives a V-belt 28 which in turn drives and rotates a driven sheave 30.

Sheave 26 is carried by and rotated with an outer sleeve 32 which carries on its right or inner end a timing belt pulley 34. This pulley or sheave 34 is driven by means of a timing belt 36 and by a timing belt pulley or sheave 38. Pulley 38 is secured to a short shaft 40 and is rotated with this shaft by a timing belt pulley or sheave 42 also carried by and secured to shaft 40. Pulley 42 drives the timing belt 44 which in turn rotates and drives timing belt pulley 46 which is attached to sleeve 48 rotatable on support shaft 20 which is preferably a fixed shaft.

Pulley 46 is secured to and drives or rotates sleeve 48. This sleeve is also secured to and moves arm 50. This arm 50 moves drive link 52 which is pivotally secured to this arm 50. The other end of this link 52 is secured in a fixed manner to the outer portion of an eccentric 54. Eccentric 54 is preferably an antifriction apparatus and has its inner portion secured to a crankshaft 56. Crankshaft 56 is rotatable in bearings disposed in a desired but not defining arrangement and as this shaft is rotated an exterior pitman arm 58 secured thereto is rotated. This arm 58 has a slot 60 formed in its outer extent. Mountable in this slot 60, so as to lengthen or shorten the film advance stroke, is an end 62 of a pitman arm 64. This end 62 is pivotally mounted to this swinging arm 58 and is adjusted in this slot 60 so as to shorten or lengthen the effective swing of arm 58. Left end 66 of pitman arm 64 as it is cycled back and forth moves shaft 70 and supporting arms 72. The lower ends of arms 72 are pivotally supported by bearing mounts 74. In the expanded view of FIG. 2 it is to be noted that the support shaft 20 is a dead shaft and does not rotate. Sheave 16 is rotatable thereon and shaft 40 which is free turning is secured to and carries timing belt pulleys 38 and 42. In practice, pulley 46 has eighteen teeth and pulley 42 has twenty teeth. Pulley 38 has eighteen teeth and pulley 34 has twenty teeth. This differential provides the desired reduction while belts 36 and 44 nominally are similar or identical.

APPARATUS OF FIG. 3

Figure 3:
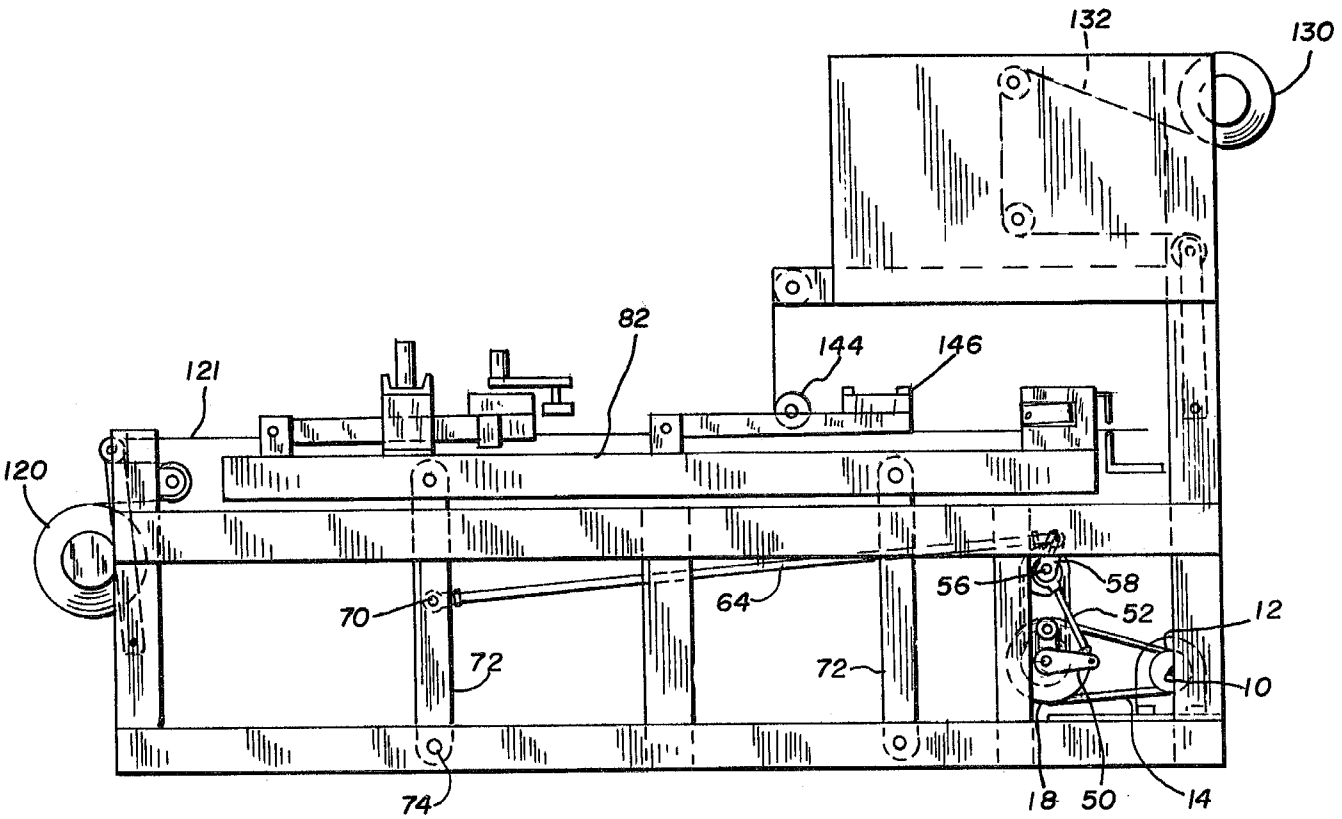
FIG. 3 represents a side view of the film forming and sealing apparatus as shown in my U.S. Pat. No. 4,048,782 in which the film is intermittently advanced and the actuation of the forming and sealing of the film is in response to the movement or actuation of the pitman arm.

The film advancing apparatus, shown in FIG. 3, is very similar to FIG. 12 in my reference patent. The embodiment shown provides the making of a package and covering in which a lower film 121 carried on a roll 120 may be rigid or semi-rigid as determined by the product to be packaged. It is contemplated that the film may be shaped or otherwise formed by apparatus as described in the reference patent. The upper film 132 is fed from a roll 130 to a pressure roller 144. If serrations are to be produced, they may be provided at a station 146. This is merely a matter of choice depending upon the package to be provided. With a package formed and filled, the film advance mechanism is actuated. A moving frame 82 is cycled back and forth in response to the movement of the pitman arm 58. This pitman arm is moved by the rotation of pulley 12 and by a motor 84.

Reference is made to my issued patent wherein the film advance occurs during the associated rotation of rollers which determines the extent of film advance. This film advance occurs during the extent of rightward travel of the frame 82 and is a result of the rotation of the rollers during the leftward movement of the frame 82. This rotation is derived from the driving of a tooth pulley or sheave by the timing belt which is secured to a fixed frame 86. The one-way clutch causes rollers to be turned clockwise when the movable frame is moved leftwardly. These one-way clutches also prevent counterclockwise rotation when the movable frame is moved rightwardly. The drive rotation of the rollers is preferably greater than the rearward or leftwardly travel of the frame 82. Preferably the rollers are rotated by a pulley as driven by the belt at about double the speed of travel of the frame 82. This results in a double advance of the film or films in relation to the rearward travel of the frame. The amount of travel of the frame 82 is selected to suit the product being packaged.

The automatic positioning device is provided by a cylinder in response to the reading of printed or like prepared marking devices on the film. Usually the advance is to move the film forwardly after it has fallen a small distance behind. This action can be reversed, if desired. Timing of a cutoff knife 150 is merely a matter of selection and can occur with every advance of the film or at multiples thereof. The apparatus as shown in FIG. 12 of the reference patent may produce one or more multiples or pockets in the film. The repetition of the apparatus enables a package to be like formed, filled, covered and severed in accordance with the package requirements.

The speed reduction provided by this apparatus enables the output speed of shaft 10 to be reduced by the difference of teeth in the four pulleys. As shaft 56 is revolved it causes the eccentric 54 to also be revolved and in accordance therewith the throw of the eccentric 54 causes arm 50 to be advanced or retarded. This movement of the eccentric and the movement of the arm 50 in relation to the eccentric 54 causes a speeding up or slowing down of the output of the shaft 56. This, of course, produces a differential in the forward movement and the rear movement and timed interval of the shaft 56. The resulting motion of the pitman arm 64 causes the frame 82 to be moved at a differential of speed. It is also to be noted that the motion of the pitman arm causes only momentarily a stopping of the frame. Subsequently, the continued movement of the arm reverses the movement of the frame. This frame and the corresponding film motion is actually a back and forth cycloidal action. This motion is very typical of any pitman arm. The eccentric causes a speed up and/or delay in the forward and back motion of the frame. The amount of eccentric motion imparted by the eccentric 54 to the arm 50 is a function of the speeding up or slowing down of the pitman arm 64. The gear reduction may be varied by changing the differential of the teeth in the pulleys 46, 42, 38 and 34. Also to be noted is that, although not shown, a belt tension or tightening device may be provided and carried by the pulley 16 so that the timing belt is maintained at a desired tension. Although preferably, because of the noise, the timing belt and pulleys are depicted, a roller chain and sprockets may also be used if desired. Preferably the belts 44 and 36 are the same length. They can be varied in length to accommodate the teeth and pitch of the pulleys. It is only necessary that the shaft 40 be carried parallel to the shaft carrying the sheave 16 and that sheave 16 be freely rotatable on shaft 22.

The above described apparatus shows a combined speed reducer mechanism and an eccentric used with this apparatus to speed up and slow down the cycling movement of the pitman arm. It is also to be noted that a conventional speed reducer can also be provided that is different from that shown. This alternate speed reducer also is connected to a shaft and arm by which an eccentric mounted on the crankshaft carrying the pitman arm may speed up or slow down the speed reduction apparatus so as to provide a differential in the speed of the film advance and the pause during which the one-way clutches are operated.

Although the preferred embodiment shows and describes toothed sprockets or pulleys and associated fixed pitch connecting belts or chains, this is not to preclude the use of V-belts and sheaves. The difficulty with non-toothed components is the possibility of slip or inaccuracy because of wear. The use of a speed differential mechanism, which allows a speed up and slow down by the use of an eccentric and associated arm, is contemplated.

The above described apparatus provides a method for the differential movement of a film moving means. The method includes advancing a film moved by a pitman arm mechanism, this improved method providing drive means by which a forward and rearward motion imparted by the pitman arm are at differing speeds, this method including the steps of: providing a speed reducer apparatus in association with a motor drive and moving a pitman arm and an associated film advance means in and with a back and forth motion and at a selected speed; rotatably supporting a crankshaft so as to carry and move said pitman arm, and mounting and carrying an eccentric on said crankshaft and with the inner portion of this eccentric movable with the rotation of this crankshaft, and as the eccentric is moved, it moves an associated arm secured to a sleeve rotatably carried on a support shaft providing therewith a determined movement of the associated arm and a speeding up and slowing down of the crankshaft speed during each revolution of the said crankshaft.

Terms such as "left", "right", "up", "down", "bottom", "top", "front", "back", "in", "out", "clockwise", "counter-clockwise" and the like are applicable to the embodiments shown and described in conjunction with the drawings. These terms are merely for the purpose of description and do not necessarily apply to the position in which the film advancing apparatus may be constructed or used.

While a particular embodiment of the speed reducer and pitman arm drive have been shown and described it is to be understood the invention is not limited thereto since modifications may be made within the scope of the accompanying claims and protection is sought to the broadest extent the prior art allows.

What is claimed is:

1. A film advancing apparatus in which the film is moved by a pitman arm mechanism, this improvement providing drive means by which a forward and rearward motion is imparted by the pitman arm at a differential speed, the improvement including:

(a) a support means;

(b) a motor drive with the output disposed to move said pitman arm mechanism and with it a film advance apparatus with and in a back and forth motion and at a selected speed;

(c) a support shaft carried by said support means;

(d) a disk-like driven member carried by bearing means and rotatable on said support shaft, this driven member movable at a reduced speed and operatively connected to the output of said motor drive;

(e) a short shaft carried by and in a web portion of said disk-like driven member;

(f) at least two substantially circular drive means carried on said short shaft and providing at least first and second drive means;

(g) a first circular driven means carried by first sleeve means rotatable on said support shaft and means for positively driving the first driven means by the first drive means;

(h) a second circular driven means carried by second sleeve means rotatable on said support shaft and means for positively driving said second driven means by said second drive means;

(i) a crankshaft supported by bearing means carried by the support means, said crankshaft carrying and moving said pitman arm;

(j) an eccentric carried by and secured to the crankshaft, said eccentric rotatably carrying a strap means thereabout;

(k) means for rotating said crankshaft by rotative forces derived from one of the circular driven means, and (l) an arm having one end operatively connected to the other circular driven means and the other end operatively connected to the eccentric by the strap means, the movement of the crankshaft by said means for rotating causing the eccentric to move said arm to thereby speed up and then slow down the speed of revolution of the crankshaft.

2. A film advancing apparatus as in claim 1 in which the support shaft is a fixed shaft.

3. A film advancing apparatus as in claim 1 in which the circular drive means carried on the short shaft are of different diameters and the circular driven means carried by sleeve means on the fixed shaft are also of different diameters.

4. A film advancing apparatus as in claim 1 in which the motor drive rotates a drive sheave or sprocket at a selected speed and direction, said drive sheave or sprocket connected operationally by a belt or chain which in turn drives and rotates a driven sheave or sprocket which is the disk-like member, said driven sheave or sprocket rotatably carried by a bearing means on said fixed shaft; said short shaft carried by and in the web portion of the driven sheave or sprocket so that as said sheave or sprocket is rotated the short shaft is carried in a circular path; bearing means provided in the web so that the short shaft is free turning as and when in a mounted condition in said web; first and second smaller sheaves or sprockets carried on and secured to said short shaft so that as this shaft is rotated these sheaves or sprockets are also turned; a third small sheave or sprocket carried by said second sleeve means on and free turning on the support shaft; a flexible belt or chain extending from said first smaller sheave or sprocket on the short shaft to said third small sheave or sprocket to move said third sheave or sprocket; said second sleeve means on the support shaft providing a drive connection between said third small sheave or sprocket and said connecting arm; a fourth small sheave or sprocket carried by said first sleeve means on and free turning on said support shaft; a flexible belt or chain extending from said second smaller sheave or sprocket on the short shaft to said fourth small sheave or sprocket carried on the support shaft, this belt or chain moving said first sleeve means providing a drive connection between said fourth small sheave or sprocket on the support shaft and a fifth sheave or sprocket and driven thereby, and a belt or chain extending from said fifth drive sheave or sprocket and driving a sixth sheave or sprocket mounted on and driving the crankshaft that imparts motion to said pitman arm.

5. A film advancing apparatus as in claim 4 in which the third sheave or sprocket is smaller than the first sheave or sprocket and the second sheave or sprocket is smaller than the fourth sheave or sprocket.

6. A film advancing apparatus as in claim 5 in which the third sheave or sprocket has eighteen teeth and the first sheave or sprocket has twenty teeth; the second sheave or sprocket has eighteen teeth and the fourth sheave or sprocket has twenty teeth.

7. A film advancing apparatus as in claim 4 in which the flexible connection from the motor drive to the support shaft is a V-belt and the associated sheaves are formed so as to accommodate the V-belt used therewith.

8. A film advancing apparatus as in claim 4 in which the flexible connection from the motor drive to the support shaft is a roller chain and the members on the motor and support shaft are roller chain sprockets, said sprockets and chain being compatible components.

9. A film advancing apparatus as in claim 4 in which the first and second small sheaves or sprockets on both the short shaft and the sleeve means on the support shaft are timing belt pulleys and the flexible belts connecting said timing belt pulleys are timing belts of appropriate pitch and length.

10. A film advancing apparatus as in claim 4 in which tighteners are provided to maintain the desired tension in the flexible belt or chain connecting the small sheaves or sprockets together.

* * * * *